US005740679A

United States Patent [19]

Ueno et al.

[11] Patent Number: 5,740,679

[45] Date of Patent: Apr. 21, 1998

[54] BINARY REFRIGERATING APPARATUS

[75] Inventors: Akitoshi Ueno; Yuji Fujimoto, both of Osaka, Japan

[73] Assignee: Daikin Industries, Ltd., Japan

[21] Appl. No.: 704,514

[22] PCT Filed: Jan. 12, 1996

[86] PCT No.: PCT/JP96/00055

§ 371 Date: Nov. 4, 1996

§ 102(e) Date: Nov. 4, 1996

[87] PCT Pub. No.: WO96/21830

PCT Pub. Date: Jul. 18, 1996

[30] Foreign Application Priority Data

Jan. 13, 1995 [JP] Japan ..... 7-003890

[51] Int. Cl.[6] ..... F25B 7/00

[52] U.S. Cl. ..... 62/175; 62/119; 62/335

[58] Field of Search ..... 62/119, 196.1, 62/197, 335, 175

[56] References Cited

U.S. PATENT DOCUMENTS

| | | | |
|---|---|---|---|
| 2,586,454 | 2/1952 | Brandin | 62/175 |
| 3,392,541 | 7/1968 | Nussbaum | 62/175 |
| 3,733,845 | 5/1973 | Lieberman | 62/335 |
| 4,402,189 | 9/1983 | Schaeffer | 62/335 |
| 4,567,733 | 2/1986 | Mecozzi | 62/175 |

FOREIGN PATENT DOCUMENTS

| | | |
|---|---|---|
| 5005567 | 1/1993 | Japan . |
| 5302763 | 11/1993 | Japan . |
| 6082106 | 3/1994 | Japan . |

*Primary Examiner*—William E. Tapolcai

*Attorney, Agent, or Firm*—Sixbey, Friedman, Leedom & Ferguson, P.C.; Gerald J. Ferguson, Jr.; Tim L. Brackett, Jr.

[57] ABSTRACT

A higher temperature side unit having a higher temperature side compressor and a condenser to form a higher temperature refrigeration cycle is disposed at a position higher than a position where a lower temperature side unit forming a lower temperature refrigeration cycle is disposed. The higher temperature side unit is provided with a bypass passage which allows refrigerant to bypass the higher temperature side compressor. A shut-off valve is disposed in the bypass passage. When an open-air temperature sensed by an open-air thermometric sensor is low, the higher temperature side compressor is deactivated and the bypass passage is opened, so that refrigerant naturally circulates in the higher temperature refrigeration cycle.

3 Claims, 2 Drawing Sheets

BINARY REFRIGERATING APPARATUS

TECHNICAL FIELD

This invention relates to a binary refrigerating apparatus.

BACKGROUND ART

A binary refrigerating apparatus is a combination of two types of refrigerating machines which carry out a lower temperature cycle and a higher temperature cycle respectively and is used for reaching a low temperature of minus several ten degrees. Since such an apparatus is highly efficient from a large compression ratio to a small compression ratio, it has an advantage of excellent energy conservation. An example of such apparatus is disclosed in Japanese Patent Application Laid-Open Gazette No. 5-5567. In this binary refrigerating apparatus, a refrigerating unit for a lower temperature side, which requires high-precision techniques for assembly and pipe connection and strict quality control, is factory-assembled so as to be formed into single-piece construction. The refrigerating unit is combined with a separate-type outdoor unit as a higher temperature side unit which has a simple structure. This results in easy on-site installation and enhanced reliability of the apparatus.

Even though the above binary refrigerating apparatus can save energy, it cannot effectively use its high compression ratio when an open-air temperature is low. In this case, it is necessary to continuously operate the outdoor unit. Thereby, the apparatus may have a disadvantage in energy conservation.

SUMMARY OF THE INVENTION

An object of the present invention is to attain enhanced energy conservation in a binary refrigerating apparatus.

Inventors have conducted various experiments and investigations on the above problem and found that at the time of a low open-air temperature, even if refrigerant in a higher temperature side unit is only naturally circulated without being compressed, this sufficiently makes it possible to absorb exhaust heat from a lower temperature side unit and discharge it outside the room. Thus, Inventors have completed the present invention.

The present invention includes a binary refrigerating apparatus comprising a lower temperature side unit (1) in which a lower temperature side compressor (3), a condensation part of a cascade condenser (4), expansion means (5) and an evaporator (6) are sequentially connected thereby forming a lower temperature refrigeration cycle. The binary refrigerating apparatus also comprises a higher temperature side unit (2) which has a higher temperature side compressor (15) and a condenser (16) for condensing refrigerant by using the air and which is connected to an evaporation part of the cascade condenser (4) through expansion means (9) so that the higher temperature side compressor (15) and the condenser (16) form a higher temperature refrigeration cycle.

Further, the higher temperature side unit (2) is disposed at a position higher than a position where the lower temperature side unit (1) is disposed. In addition, the binary refrigerating apparatus further comprises an open-air thermometric sensor (21) for sensing an open-air temperature, and natural circulation means for naturally circulating refrigerant in the higher temperature refrigeration cycle when an open-air temperature sensed by the open-air thermometric sensor (21) is below a specific temperature.

The natural circulation means includes a bypass passage (19) which allows refrigerant to bypass the higher temperature side compressor (15), a shut-off valve (20) for opening and closing the bypass passage (19), and control means (22) for deactivating the higher temperature side compressor (15) while opening the shut-off valve (20) when an open-air temperature sensed by the open-air thermometric sensor (21) is below the specific temperature.

The natural circulation means also includes a bypass passage (10) which allows refrigerant to bypass the expansion means (9) in the higher temperature refrigeration cycle, a shut-off valve (11) for opening and closing the bypass passage (10), and control means (22) for deactivating the higher temperature side compressor (15) while opening the shut-off valve (11) when an open-air temperature sensed by the open-air thermometric sensor (21) is below the specific temperature.

During operation, when an open-air temperature is high, the higher temperature side compressor (15) is operated. Thereby, refrigerant in the higher temperature side unit (2) is compressed at a high compression ratio, so that the refrigerant is liquefied in the condenser (16) even if the open-air temperature is high. This allows the refrigerant from the higher temperature side unit (2) to heat-exchange, at the cascade condenser (4), with refrigerant in the lower temperature side unit (1).

When an open-air temperature is low, the higher temperature side compressor (15) is deactivated. Also, refrigerant in the higher temperature side unit (2), whose temperature has risen due to heat exchange at the cascade condenser (4), is heat-exchanged at the condenser (16) with the air due to the low open-air temperature thereby liquefying the refrigerant. In this case, since the higher temperature side unit (2) is at a position higher than the position of the lower temperature side unit (1), the liquefied refrigerant flows into the evaporation part of the cascade condenser (4) due to gravitation. Then, the liquefied refrigerant is heat-exchanged with refrigerant in the lower temperature side unit (1) thereby causing evaporation and expansion of the refrigerant. The evaporated refrigerant rises to the condenser (16) located at the higher position. In this manner, natural circulation (circulation by gravitation) of refrigerant is implemented.

When an open-air temperature is low, the higher temperature side compressor (15) is deactivated and the bypass passage (19) is opened. Thereby, natural circulation is made in such a manner that refrigerant in the higher temperature side unit (2), whose temperature has risen due to heat exchange at the cascade condenser (4), bypasses the higher temperature side compressor (15) and then flows into the condenser (16). This prevents the higher temperature side compressor (15) from interfering with the flow of the refrigerant during natural circulation, thereby increasing a circulation flow rate of refrigerant.

When an open-air temperature is low, refrigerant circulates in such a manner as to bypass the expansion means (9) in the higher temperature refrigeration cycle, so that flow resistance of refrigerant can be decreased. This provides an advantage of being able to obtain a desired circulation flow rate of refrigerant.

The advantages of the present invention are as follows. In the binary refrigerating apparatus of the present invention, a higher temperature side unit (2) is disposed at a position higher than a position where a lower temperature side unit (1) is disposed and an open-air thermometric sensor (21) is provided for sensing an open-air temperature. The refrigerating apparatus naturally circulates refrigerant in a higher temperature refrigeration cycle when an open-air temperature sensed by the open-air thermometric sensor (21) is below a specific temperature. Accordingly, this prevents the higher temperature side compressor (15) from being inefficiently operated while eliminating a large reduction in cooling performance, thereby resulting in increased energy conservation.

The system for naturally circulating refrigerant in a higher temperature refrigeration cycle includes a bypass passage (19) which allows refrigerant to bypass the higher temperature side compressor (15), a shut-off valve (20) for opening and closing the bypass passage (19), and control means (22) for deactivating the higher temperature side compressor (15) while opening the shut-off valve (20) when an open-air temperature sensed by the open-air thermometric sensor (21) is below the specific temperature. Accordingly, this system prevents the higher temperature side compressor (15) from interfering with the flow of the refrigerant during natural circulation, thereby increasing a circulation flow rate of refrigerant. This results in the advantage of being able to obtain a desired cooling performance.

When an open-air temperature is low, refrigerant circulates in such a manner as to bypass the expansion means (9) in the higher temperature refrigeration cycle. Accordingly, the flow resistance of refrigerant can be decreased, so that a natural circulation flow rate of refrigerant can be increased. This results in the advantage of being able to obtain a desired cooling performance.

BEST MODE FOR CARRYING OUT THE INVENTION

Figure 1:
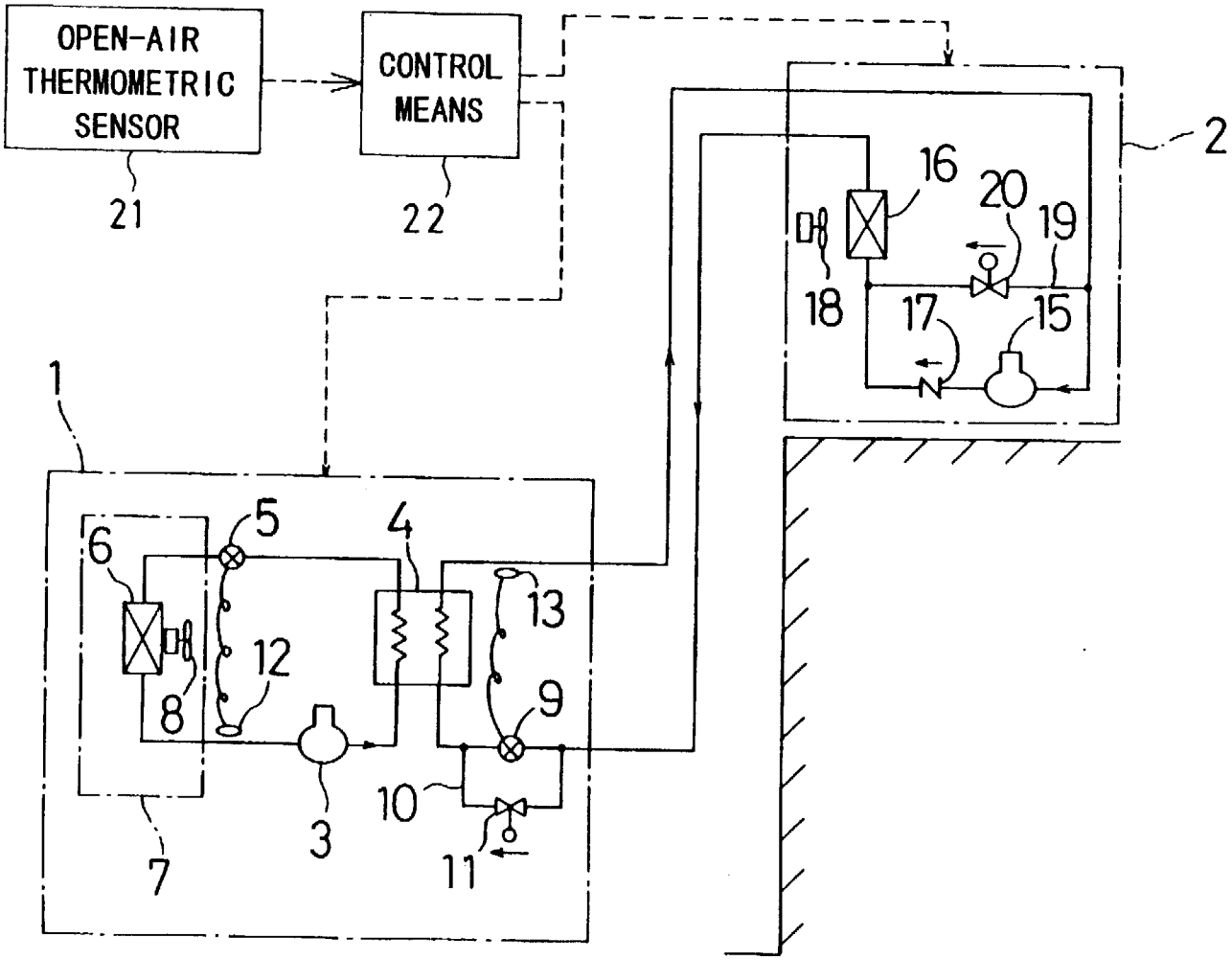
FIG. 1 is a refrigerant circuit diagram of a binary refrigerating apparatus showing an embodiment of the present invention.

Below, description is made about an embodiment of the present invention with reference to the drawings. FIG. 1 shows a refrigerant circuit of the binary refrigerating apparatus of the present invention. The binary refrigerating apparatus comprises a lower temperature side unit (1) provided with an indoor deep freezer, and a higher temperature side unit (2) disposed on a rooftop. The higher temperature side unit (2) of the present embodiment is disposed at a position 10 m higher than a position where the lower temperature side unit (1) is disposed.

The lower temperature side unit (1) includes a lower temperature side compressor (3), a cascade condenser (4), a thermo-sensing expansion valve (5) as a lower temperature side expansion means, and an evaporator (6) provided inside a deep freezer (7). The evaporator (6) is provided with an in-freezer fan (8). The lower temperature side compressor (3), a condensation part of the cascade condenser (4), the thermo-sensing expansion valve (5) and the evaporator (6) are sequentially connected to form a lower temperature refrigeration cycle.

A thermo-sensing expansion valve (9) is connected on an inlet port side of an evaporation part of the cascade condenser (4) and functions as a higher temperature side expansion means forming the below-mentioned higher temperature refrigeration cycle. A bypass passage (10) allows refrigerant to bypass the expansion valve (9), and a solenoid shut-off valve (11) is used for opening and closing the bypass passage (10).

On a discharge port side of the evaporator (6) and on a discharge port side of the evaporation part of the cascade condenser (4), respective temperature sensing bulbs (12,13) are attached for the thermo-sensing expansion valves (5,9) respectively.

For the lower temperature side unit (1), its entire assembly including attachments of all components and refrigerant pipe connection is made at a special factory. That is, the lower temperature side unit (1) is factory-assembled. At the site of installation, only an installation of the lower temperature side unit (1) and a pipe connection to the evaporation part of the cascade condenser (4) are required.

Next, the higher temperature side unit (2) includes a higher temperature side compressor (15), a condenser (16) for condensing refrigerant by using the air and a non-return valve (17). The condenser (16) is provided with an outdoor fan (18). This higher temperature side compressor (15), the non-return valve (17), the condenser (16), the higher temperature side thermo-sensing expansion valve (9) of the lower temperature side unit (1) and the evaporation part of the cascade condenser (4) are sequentially connected to form a higher temperature refrigeration cycle.

The higher temperature side unit (2) further includes a bypass passage (19) which allows refrigerant to bypass the higher temperature side compressor (15) and the non-return valve (17) and which connects the discharge port of the evaporation part of the cascade condenser (4) to the condenser (16). The bypass passage (19) is provided with a solenoid shut-off valve (20) for opening and closing the bypass passage.

Further, the binary refrigerating apparatus comprises, on a rooftop where the higher temperature side unit (2) is disposed, an open-air thermometric sensor (21) for sensing an open-air temperature. The apparatus further comprises a control means (22) for controlling respective operations of the lower temperature side compressor (3), the in-freezer fan (8), the solenoid shut-off valves (11,20), the higher temperature side compressor (15) and the outdoor fan (18) based on an open-air temperature sensed by the open-air thermometric sensor (21).

Figure 2:
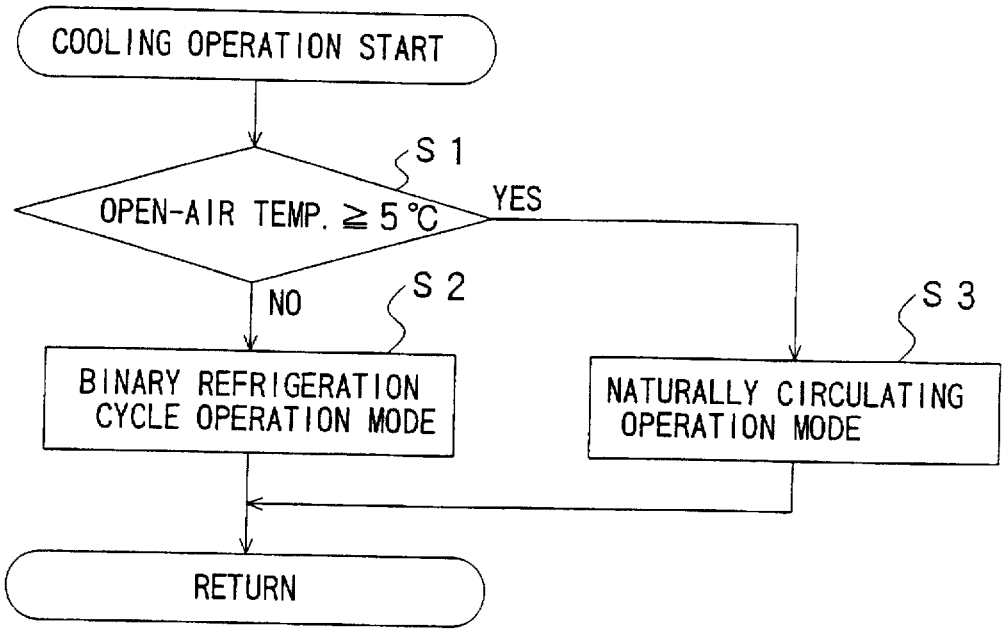
FIG. 2 is a control flow chart.

Specifically, the control means (22) controls the respective components in the following manner as shown in FIG. 2: the program determines, at Step S1, if an open-air temperature is 5° C. or above; when the open-air temperature is 5° C. or above, the program proceeds to Step S2 to enter a binary refrigeration cycle operation mode; on the other hand, when the open-air temperature is below 5° C., the program proceeds from Step S1 to Step S3 to enter a naturally circulating operation mode. Operational states of the respective components in the respective operation modes are shown in the following Table 1.

TABLE 1

| | Binary refrigeration cycle operation mode | Naturally circulating operation mode |
|---|---|---|
| Higher temp. side unit | | |
| Compressor | ON | OFF |
| Fan | ON | ON |
| Shut-off | OFF | ON |

TABLE 1-continued

| | Binary refrigeration cycle operation mode | Naturally circulating operation mode |
|---|---|---|
| Valve | | |
| Lower temp. side unit | | |
| Compressor | ON | ON |
| Fan | ON | ON |
| Shut-off Valve | OFF | ON |

Figure 3:
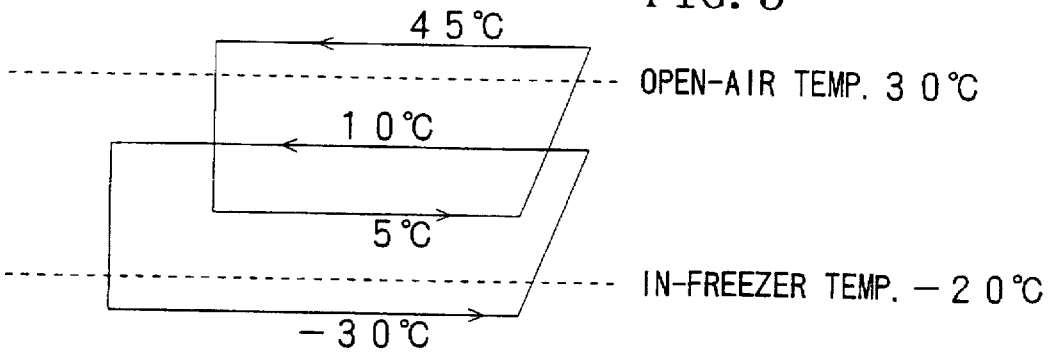
FIG. 3 is a p-i chart (pressure-enthalpy chart) in a binary refrigeration cycle.

Accordingly, when an open-air temperature is, for example, 30° C., the solenoid shut-off valves (11,20) close the bypass passages (10,19) so that the refrigerating apparatus operates in binary refrigeration cycle operation mode. In this operation mode, if the temperature inside the deep freezer should be set to −20° C., as shown in a p-i chart of FIG. 3, the refrigerating apparatus is designed so that an evaporation temperature in the evaporator (6) is −30° C., a temperature in the primary side of the cascade condenser (4) is 10° C., a temperature in its secondary side is 5° C. and a condensation temperature in the condenser (16) is 45° C.

Thus, in the lower temperature refrigeration cycle, refrigerant compressed by the lower temperature side compressor (3) liquefies at 10° C. in the condensation part of the primary side of the cascade condenser (4), reduces in pressure and expands at the thermo-sensing expansion valve (5), evaporates at −30° C. in the evaporator (6) to take evaporation heat from the surrounding thereby keeping the temperature inside the deep freezer at −20° C. The refrigerant is then, again, compressed in the lower temperature side compressor (3).

In the higher temperature refrigeration cycle, refrigerant compressed by the higher temperature side compressor (15) liquefies at 45° C. in the condenser (16) by heat exchange with the air, reduces in pressure and expands at the thermo-sensing expansion valve (9), evaporates at 5° C. in the evaporation part of the secondary side of the cascade condenser (4) by heat exchange with refrigerant in the lower temperature refrigeration cycle thereby liquefying refrigerant in the lower temperature refrigeration cycle. The refrigerant in the higher temperature refrigeration cycle is then compressed, again, in the higher temperature side compressor (15).

Figure 4:
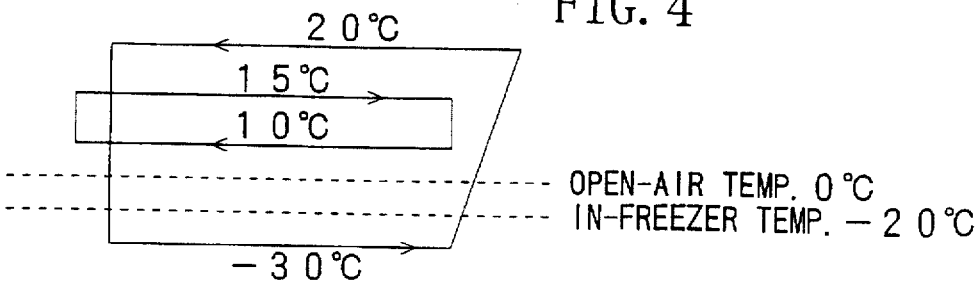
FIG. 4 is a p-i chart in natural circulation.

Meanwhile, when an open-air temperature is, for example, 0° C., the solenoid shut-off valves (11,20) open the bypass passages (10,19) and the higher temperature side compressor (15) is deactivated, so that the refrigerating apparatus operates in a naturally circulating operation mode. In this operation mode, as shown in FIG. 4, a temperature of the primary side of the cascade condenser (4) is 20° C., a temperature of its secondary side is 15° C. and a condensation temperature of the condenser (16) is 10° C.

Specifically, in the higher temperature refrigeration cycle, refrigerant bypasses the higher temperature side compressor (15) of the higher temperature side unit (2), liquefies at 10° C. in the condenser (16) by heat exchange with the air, flows downward to the lower temperature side unit (1) by gravitation, bypasses the thermo-sensing expansion valve (9) and flows into the evaporation part of the secondary side of the cascade condenser (4). In the evaporation part, the refrigerant evaporates and expands at 15° C. by heat exchange with refrigerant in the lower temperature refrigeration cycle while liquefying the refrigerant in the lower temperature refrigeration cycle, and then rises to the higher temperature side unit (2).

In the naturally circulating cycle, since refrigerant bypasses the higher temperature side compressor (15), the non-return valve (17) and the thermo-sensing expansion valve (9), the flow resistance of refrigerant can be reduced thereby increasing a natural circulation flow rate of refrigerant. This provides an advantage of being able to obtain a desired cooling efficiency. Further, since the outdoor fan (18) is operated even during the natural circulation, this has an advantage in condensing refrigerant in the condenser (16).

Suppose that the higher temperature side unit (2) has 5 hp, the lower temperature side unit (1) has 3 hp, an open-air temperature is 0° C. and a temperature inside the deep freezer is −20° C. A comparison was made in the energy efficiency ratio (EER) between the above-mentioned two operation modes. The results are as follows.

In the binary refrigeration cycle operation mode, the cooling performance was 6150 kcal/h, the power draw of the lower temperature side unit (1) was 2.64 kW, the power draw of the higher temperature side unit (2) was 2.6 kW, and the EER was 1.17.

On the other hand, in the naturally circulating operation mode, since the circulation flow ratio of refrigerant was reduced by the increase in compression ratio in the lower temperature refrigeration cycle, the cooling performance was 5550 kcal/h and the power draw of the lower temperature side unit (1) was 3.24 kW larger than that in the binary refrigeration cycle operation mode. The EER was 1.71.

INDUSTRIAL APPLICABILITY

The binary refrigerating apparatus of the present invention is useful for deep freezers used at a low temperature of minus several ten degrees, and is suitable for attaining energy conservation without great degradation in cooling performance.

We claim:

1. A binary refrigerating apparatus having:

a lower temperature side unit in which a lower temperature side compressor, a condensation part of a cascade condenser, expansion means and an evaporator are sequentially connected thereby forming a lower temperature refrigeration cycle; and a higher temperature side unit which has a higher temperature side compressor and a condenser for condensing refrigerant by using the air and which is connected to an evaporation part of the cascade condenser through expansion means so that the higher temperature side compressor and the condenser form a higher temperature refrigeration cycle, the improvement comprising:

said higher temperature side unit being disposed at a position higher than a position where said lower temperature side unit is disposed, an open-air thermometric sensor for sensing an open-air temperature; and natural circulation means for naturally circulating refrigerant in the higher temperature refrigeration cycle when an open-air temperature sensed by the open-air thermometric sensor is below a specific temperature.

2. A binary refrigerating apparatus according to claim 1, wherein said natural circulation means includes:

a bypass passage which allows refrigerant to bypass the higher temperature side compressor;

a shut-off valve for opening and closing the bypass passage; and control means for deactivating the higher temperature side compressor while opening the shut-off valve when an open-air temperature sensed by the open-air thermometric sensor is below the specific temperature.

3. A binary refrigerating apparatus according to claim 1, wherein said natural circulation means includes:

a bypass passage which allows refrigerant to bypass the expansion means in the higher temperature refrigeration cycle;

a shut-off valve for opening and closing the bypass passage; and control means for deactivating the higher temperature side compressor while opening the shut-off valve when an open-air temperature sensed by the open-air thermometric sensor is below the specific temperature.

* * * * *